United States Patent [19]

Manea

[11] Patent Number: 4,848,415

[45] Date of Patent: Jul. 18, 1989

[54] MACHINE FOR FORMING A TUCKED SELVEDGE, LIGHTENED AND OF LOW THICKNESS, IN FABRICS PRODUCED ON SHUTTLE-LESS LOOMS

[75] Inventor: Giovanni Manea, Schio, Italy

[73] Assignee: 501 Construzioni Meccaniche Manea S.r.l., Vincenza, Italy

[21] Appl. No.: 131,625

[22] Filed: Dec. 10, 1987

[30] Foreign Application Priority Data

May 25, 1987 [IT] Italy ..... 20655 A/87

[51] Int. Cl.[4] ..... D03D 47/48

[52] U.S. Cl. ..... 139/434

[58] Field of Search ..... 139/433, 434

[56] References Cited

U.S. PATENT DOCUMENTS

| | | | |
|---|---|---|---|
| 4,076,049 | 2/1978 | Manea | 139/434 |
| 4,078,586 | 3/1978 | Porter et al. | 139/434 |
| 4,600,039 | 7/1986 | Corain | 139/434 |

*Primary Examiner*—Henry S. Jaudon

*Attorney, Agent, or Firm*—Shlesinger, Fitzsimmons & Shlesinger

[57] ABSTRACT

A machine is disclosed which forms a tucked selvedge in fabrics produced on shuttle-less looms, of the type in which at least two weft threads are tucked simultaneously in the same warp shed, and in which the principal shaft rotates at a number of revolutions equal to that of the shaft of the loom on which the machine for forming tucked selvedge is mounted divided by the number of weft threads tucked simultaneously in the same warp shed. The movement of the hook-needle, the thread-seizing device or pincer and the weft-thread cutting unit, or scissors, is at each instant positively controlled by a set of cams mounted on the shaft of the tucked selvedge forming machine and connected with the said hook-needle through respective linkage systems, the said cams being operative for an angle equal to 360° divided by the number of weft threads that are simultaneously tucked in the same warp shed.

5 Claims, 6 Drawing Sheets

MACHINE FOR FORMING A TUCKED SELVEDGE, LIGHTENED AND OF LOW THICKNESS, IN FABRICS PRODUCED ON SHUTTLE-LESS LOOMS

The present invention relates to an improved machine for forming a tucked selvedge, lightened and of low thickness, in fabrics produced on shuttle-less looms.

The tucked selvedge forming machine according to the invention is of the type described and illustrated in a detailed manner in U.S. Pat. No. 4,070,049 and in Italian Utility Model Application No. 20870 B/82 filed on Feb. 17, 1982.

In order better to understand the present invention, which can however be applied also to tucked selvedge forming machines of different type, the above-mentioned documents should be considered as forming part of this specification, and the relevant technology, which is however well-known to persons skilled in the art, may also be better comprehended therefrom.

To form tucked selvedges in fabrics produced on shuttle-less looms it is known to persons skilled in the art to simultaneously tuck, in the same warp shed, the ends of two or more weft threads.

Such technique, which is in particular applied to produce sponge fabrics, requires that the movement of the hook-needle of the tucked selvedge forming machine be synchronized with that of the loom components that form the fabric.

It is known to obtain the said synchronization by cyclically disengaging the hook-needle control link from its actuating link, which is controlled by the tucked selvedge forming machine shaft which rotates at the same speed as the shaft of the loom.

However, such a system is only satisfactory when the tucked selvedge forming machine is mounted on a loom operating at a relatively low speed.

With modern looms, which attain operationg speeds of the order of 600 picks per minute, tucked selvedge forming machines of the said type are absolutely impossible to use satisfactorily.

For the electromechanical systems which disengage the hook-needle from its actuating lever are unable to operate with any precision at such high speeds.

It has to be borne in mind that the hook-needle control linkage bears a cam-sensing idle roller which, by means of an electromagnet connected to the said linkage, is sequentially restrained to and freed from the operative external profile of an actuating cam which is keyed to the main shaft of the tucked selvedge forming machine.

It is readily seen that it is practically impossible to control at each moment, and with the extreme precision called for in such cases, the position of the sensor vis-à-vis the cam if this latter rotates at very high speeds.

The object of the present invention is to obviate the drawbacks of the known art by embodying a tucked selvedge forming machine that will form, in a fabric produced on a shuttle-less loom operating at very high speeds of the order of about 600 picks/minute, a tucked selvedge of the type in which at least two weft threads are tucked simultaneously in the same warp shed.

To achieve the said object, the invention embodies a tucked selvedge forming machine of the kind forming subject matter of U.S. Pat. No. 4,076,049 and Italian Utility Model Application No. 20870 B/82 used to form a tucked selvedge in fabrics produced on shuttle-less looms, of the type in which at least two warp threads are tucked simultaneously in the same warp shed, wherein the main shaft of the forming machine rotates at a number of revolutions that is equal to the number of revolutions of the shaft of the loom on which the forming machine is mounted, divided by the number of warp threads tucked simultaneously in the same warp shed, and wherein the movement of the hook-needle, the weft thread seizing pincer and the weft-thread cutting unit, or scissor, is at each instant positively controlled through the intermediary of a set of cams mounted on the forming machine shaft and connected to the said hook-needle through respective linkage systems, the said cams being operative for an angle equal to 360° divided by the number of weft threads tucked simultaneously in the same warp shed.

The structural and functional characteristics of the invention and its advantages over the know art will become more apparent ffrom an examination of the following description, referred to the attached drawings which show an example of a tucked selvedge forming machine actuated in accordance with the invention.

Figure 5:
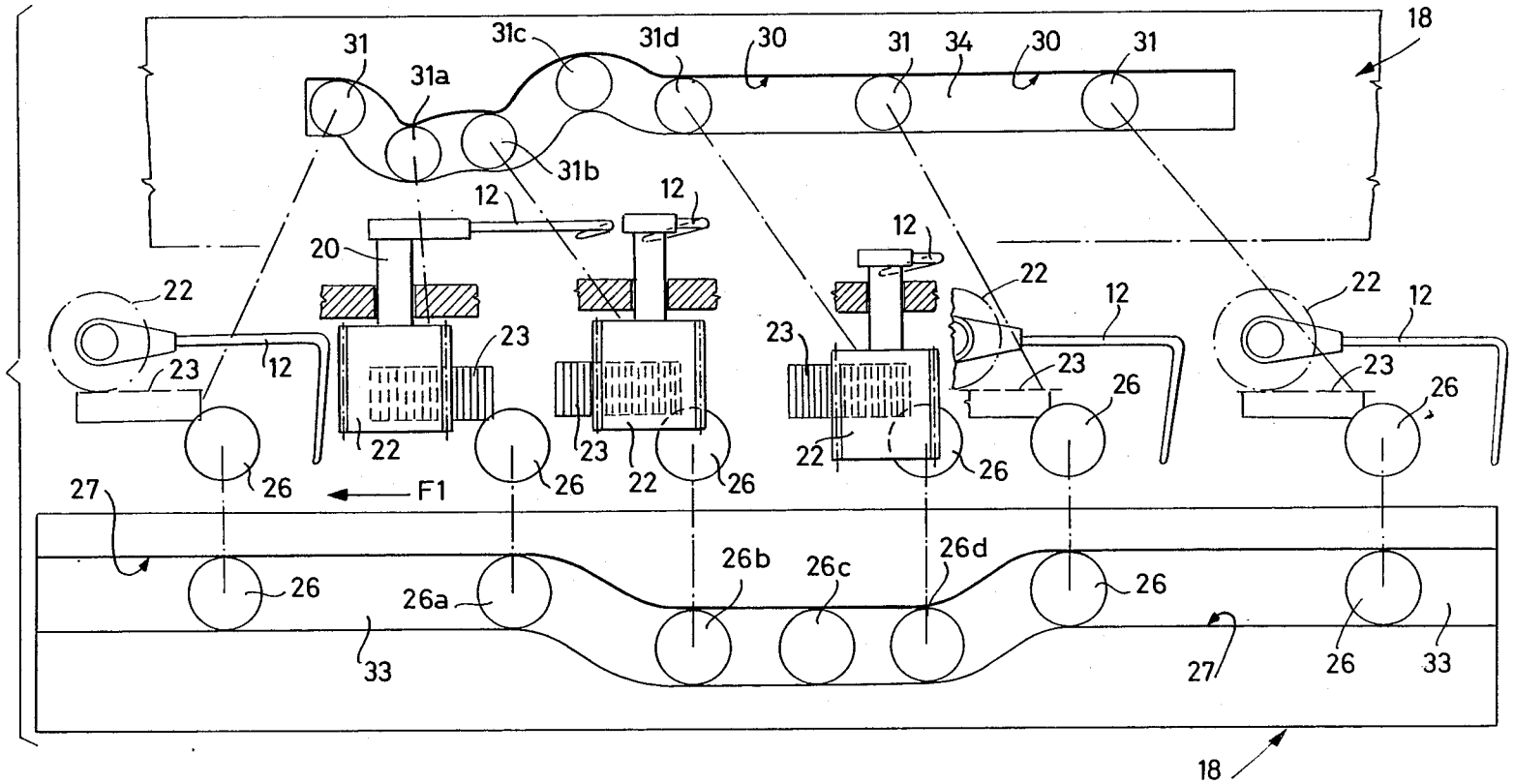
Figure 6:
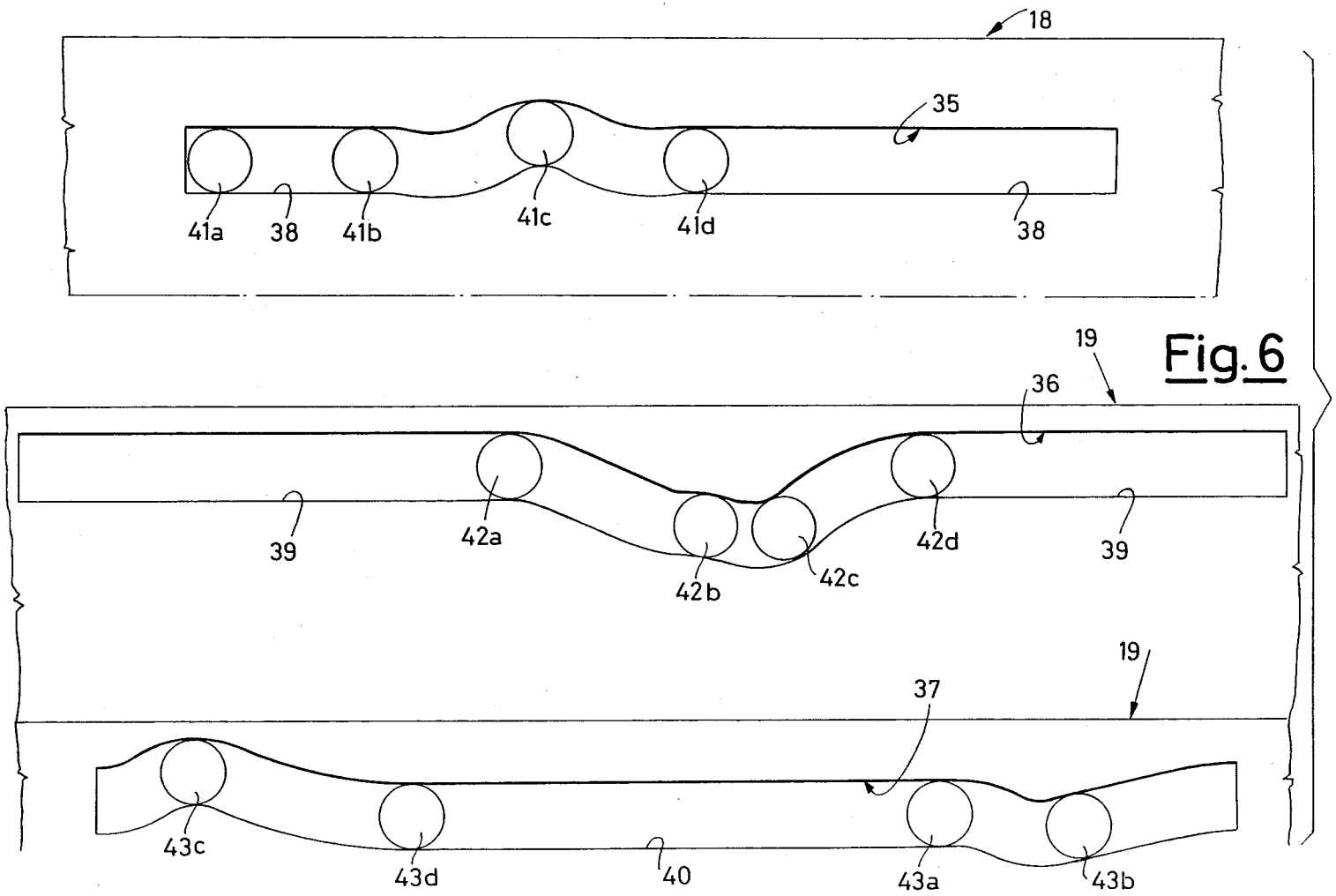

FIG. 5 is an operating schematic showing the flat development of profiles of the cam that controls the combined rotation-translation movement of the hook-needle, in which there are also shown the different significant position of said needle, the first and the last in plan, and in section the three intermediate positions; and FIG. 6 is a view as in FIG. 5 but illustrating the profiles of the cams controlling the movement of the weft thread seizing pincer and the weft thread scissors.

Referring to the drawings the tucked selvedge forming machine in question is indicated overall by 10 and consists structurally of a box-shaped body 11 containing all the control linkages for a hook-needle 12, a weft-thread seizing pincer 13 and weft-thread scissors 14.

The numeral 15 indicates the main shaft of the tucked selvedge forming machine which receives motion from the main shaft of the loom - shown diagrammatically at 16, through a kinematic reduction chain shown diagrammatically at 17.

In accordance with the invention the rotation speed of the shaft 15 of the tucked selvedge forming machine is equal to the speed of rotation of the shaft 16 of the weaving loom, with which the forming machine is operationally associated, divided by the number of weft threads that are tucked simultaneously in warp shed by the hook-needle 12. On the shaft 15 there are keyed two cams 18, 19 which are operatively connected, by means of suitable kinematic chains, to the needle 12, the pincer 13 and the scissors 14.

The said kinematic chains are illustrated in the drawings and will here be described only in a summary manner in that, as structure, they do not form a part of the present invention and can be of any kind known to persons skilled in the art, for example as described and illustrated in detail in U.S. Pat. No. 4,076,049 and Italian Utility Model application No. 20870 B/82.

Briefly, the hook-needle 12 can be controlled as described in the aforesaid Italian Utility Model application, i.e. by the agency of a shaft 20, having a combined rotation-translation movement, on the free end of which the needle 12 is mounted in a position-wise adjustable manner.

To such end, the shaft 20 is supported within a seat 21 fixed to the front of the box-shaped body 11 and, at the end of it opposite the needle 12, carries a pinion 22 which engages a rack 23 that controls the rotation of the shaft 20.

The rack 23 is fixed to a slide 24 which is guided so as to be translated within a seat 25 of the body 11. On the slide 24 there is also mounted radially an idle roller 26 engaged by a shaped cam track or guide 27 of the cam 18.

The kinematic chain consisting of the guide 27, the roller 26, the slide 24, the rack 23, the pinion 22 and the shaft 20 controls the rotation movement of the hook-needle 12.

The translation of the needle 12, on the other hand, is controlled- again by the agency of the shaft 20—by means of a bell crank lever 28 oscillating at 29.

The oscillation of the lever 28 is controlled by a shaped guide 30 of the cam 18 which engages an idle roller 31 mounted at one end of the lever 28, the opposite end of which is restrained at 32 to the shaft 20.

It is thus shown cleally that the rotation of the cam 18, and thus of the guides 27, 30, causes a combined rotation-and-to-and-fro-translation movement of the needle 12, which actuates the tucking of the weft threads in the warp shed in a manner equivalent to that described in the aforesaid prior patent and application.

However, according to the present invention, since the main shaft 15 of the tucked selvedge forming machine rotates an appreciably slower speed than the shaft 16 of the weaving loom, and since the tucked selvedge forming machine is intended to form a lightened and low-thickness tucked selvedge, in which the hook-needle 12 simultaneously tucks at least two weft-threads in the same warp shed, then at each rotation of the shaft 15 the needle 12 will operate only along a limited angle while for the remaining angle it will be in a non-operating condition, since it must be made to wait for the tucking into the warp shed of the pre-set number of weft threads, which have to be tucked in a single operating step.

If, for example, the weft threads to be simltaneously tucked in one-and the same warp shed were two in number, and the weaving loom operated at 600 picks a minute, then the tucked selvedge forming machine will operate at 300 picks per minute and the hook-needle will remain inoperative for an angle of rotation of about 180° of the shaft 15.

In other words the needle will be operative for an angle of rotation of the shaft 15 equal to 360° divided by the number of weft threads tucked simultaneously in one-and-the same warp shed.

Such manner of operating is clearly shown in FIG. 5 of the drawings which shows how in the rectilinear sections 33 and 34 of the guides 27 nd 30 respectively, the cam 18 transmits no motion to the needle 12 through the aforesaid the kinematic chains; on the other hand, in the shaped sections, the needle 12 is actuated to move with a rotational-translational movement to effect, in a manner per se known, the tucking of several weft threads in one and the same warp shed.

More specifically, and as clearly shown in FIG. 5, considering the cam 18 to rotate in the direction shown in FIG. B, considering the cam 18 to rotate in the direction shown by the arrow F1, the shaft 20 and thus the needle 12 will first be caused to translate forwards, then to rotate downwards until proximal to the weft thread retained by the pincer 13, and then to translate backwards for a short section, then to oscillate and translate forwards and, lastly, to oscillate backwards again to the aforesaid "wait" position.

At the same time, through the agency of a third shaped guide 35 of the cam 18, and two shaped guides 36, 37 of the cam 19, the pincer 13 and the scissors 14 will be caused to move in synchrony with the needle 12 in order to assure a correct tucking of the weft threads in the warp shed.

Figure 1:
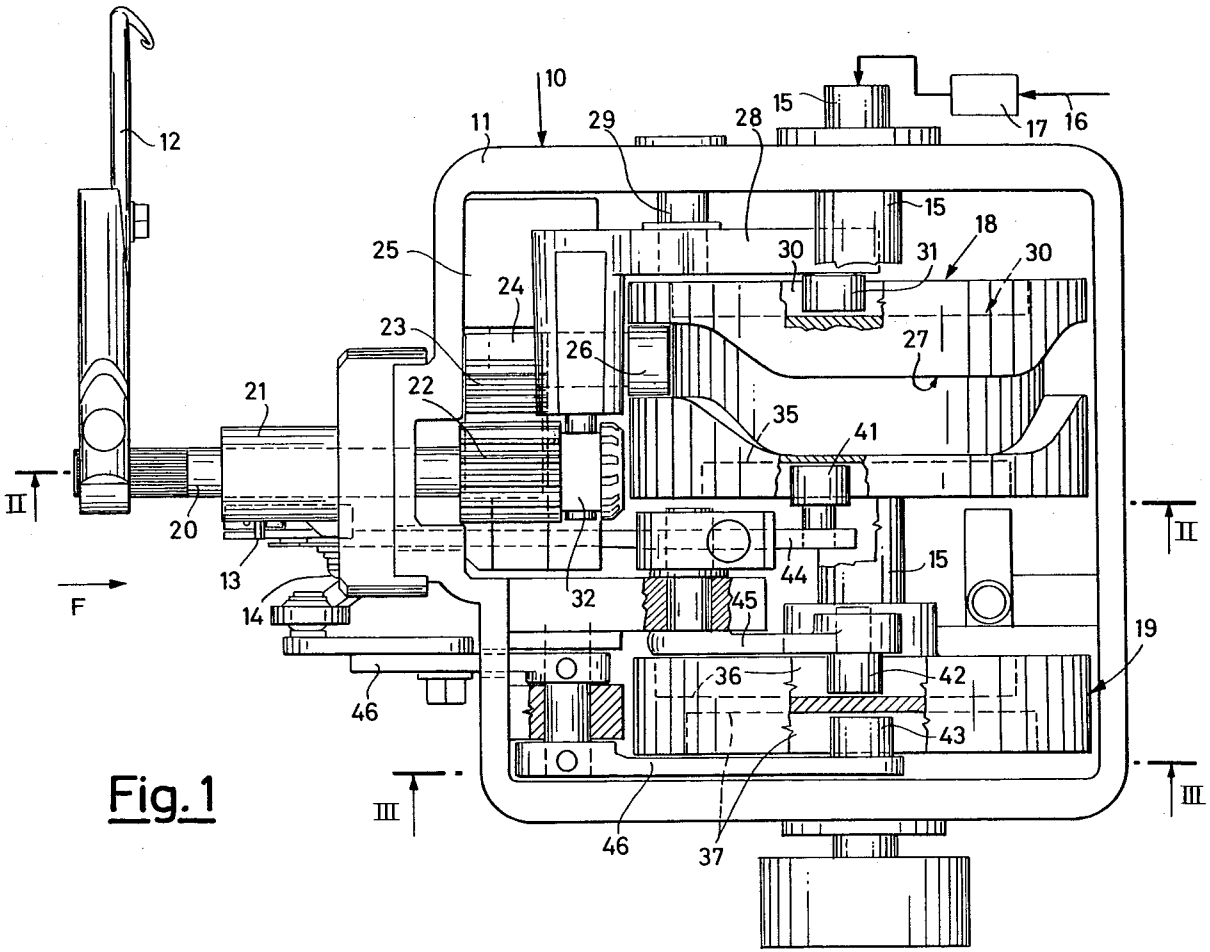
FIG. 1 is a plan view illustrating the forming machine in question without its cover and with the hook-needle in the non-operative raised "wait" position.
Figure 2:
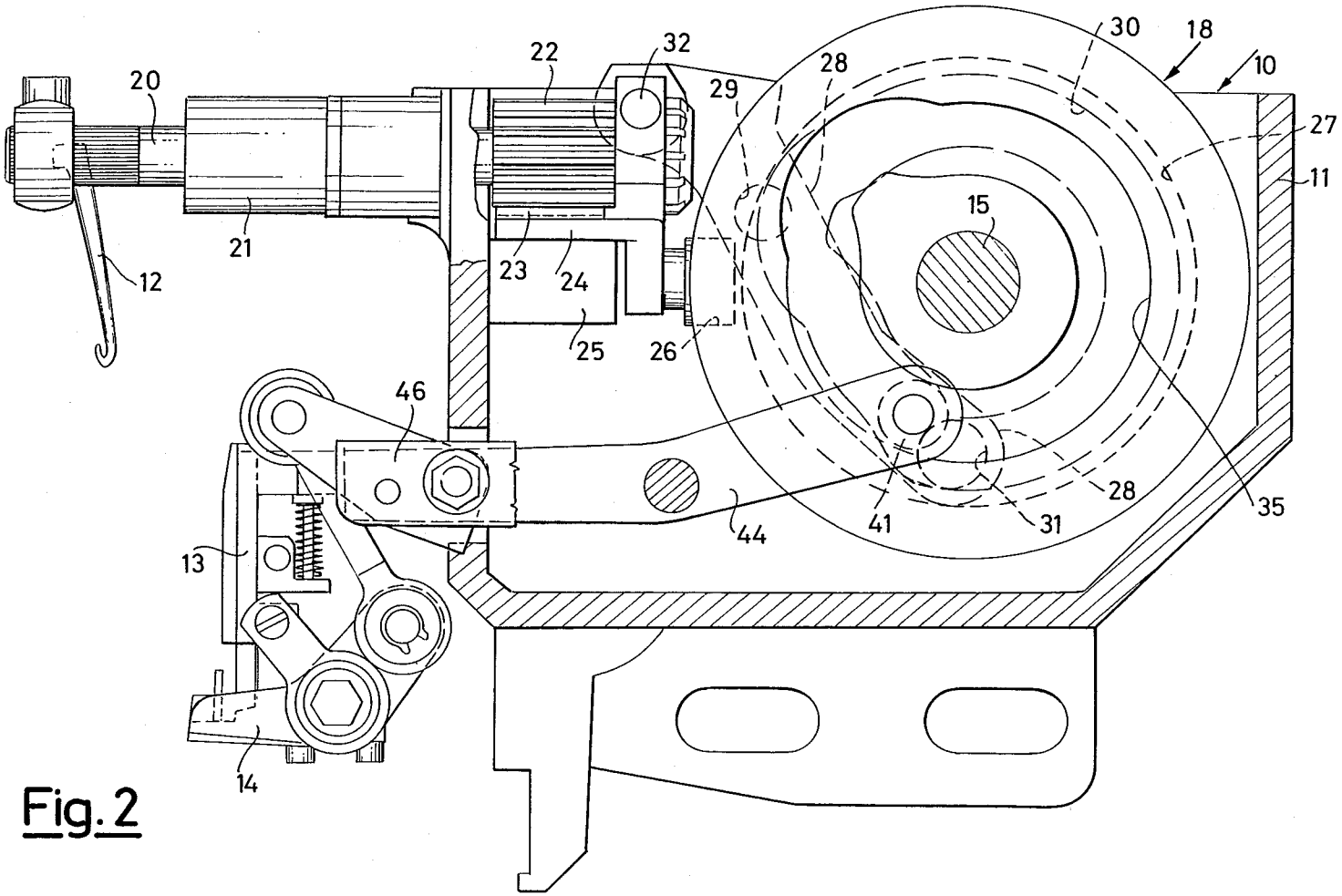
FIG. 2 is a sectional view taken through the line II—II in FIG. 1.
Figure 3:
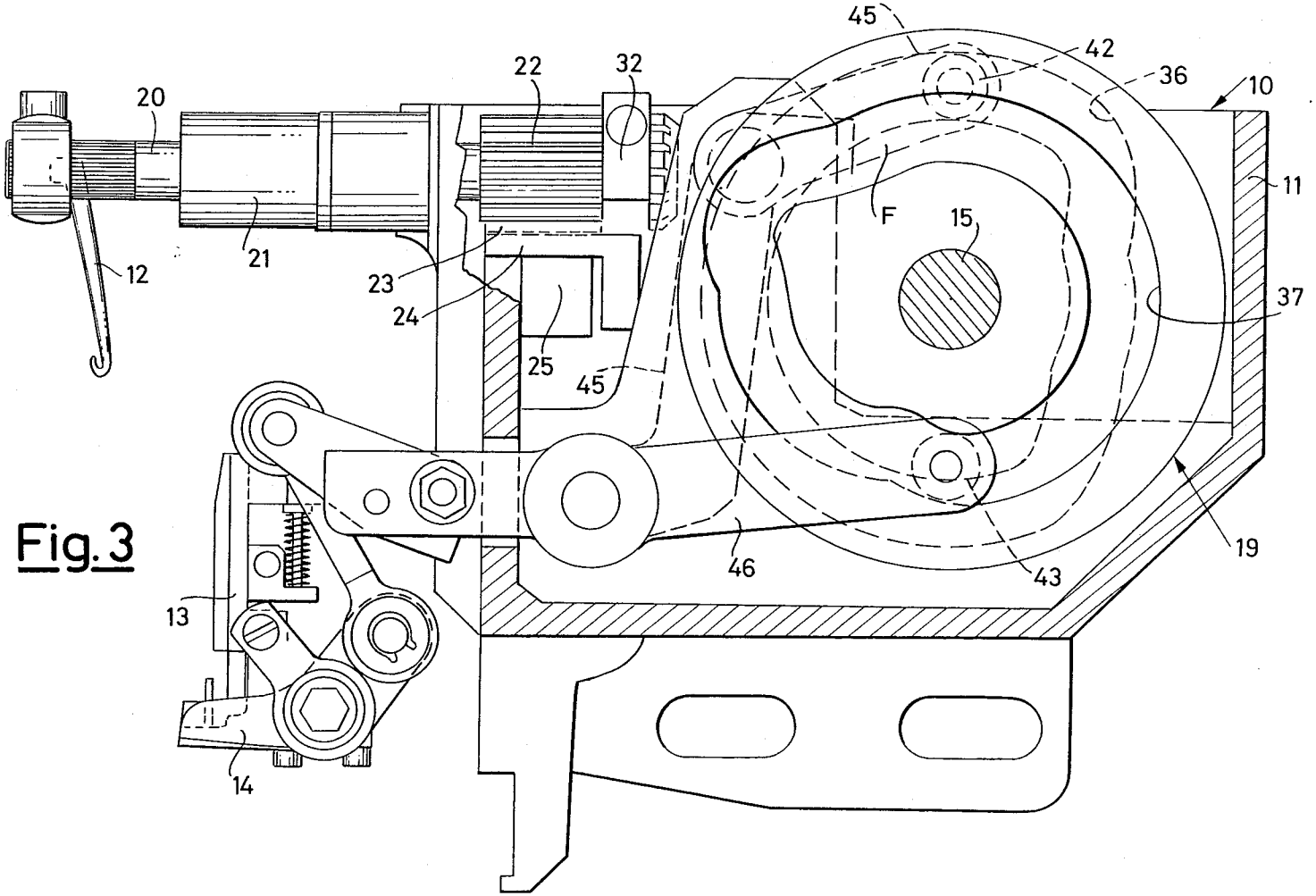
FIG. 3 is a sectional view taken through the line III—III in FIG. 1.
Figure 4:
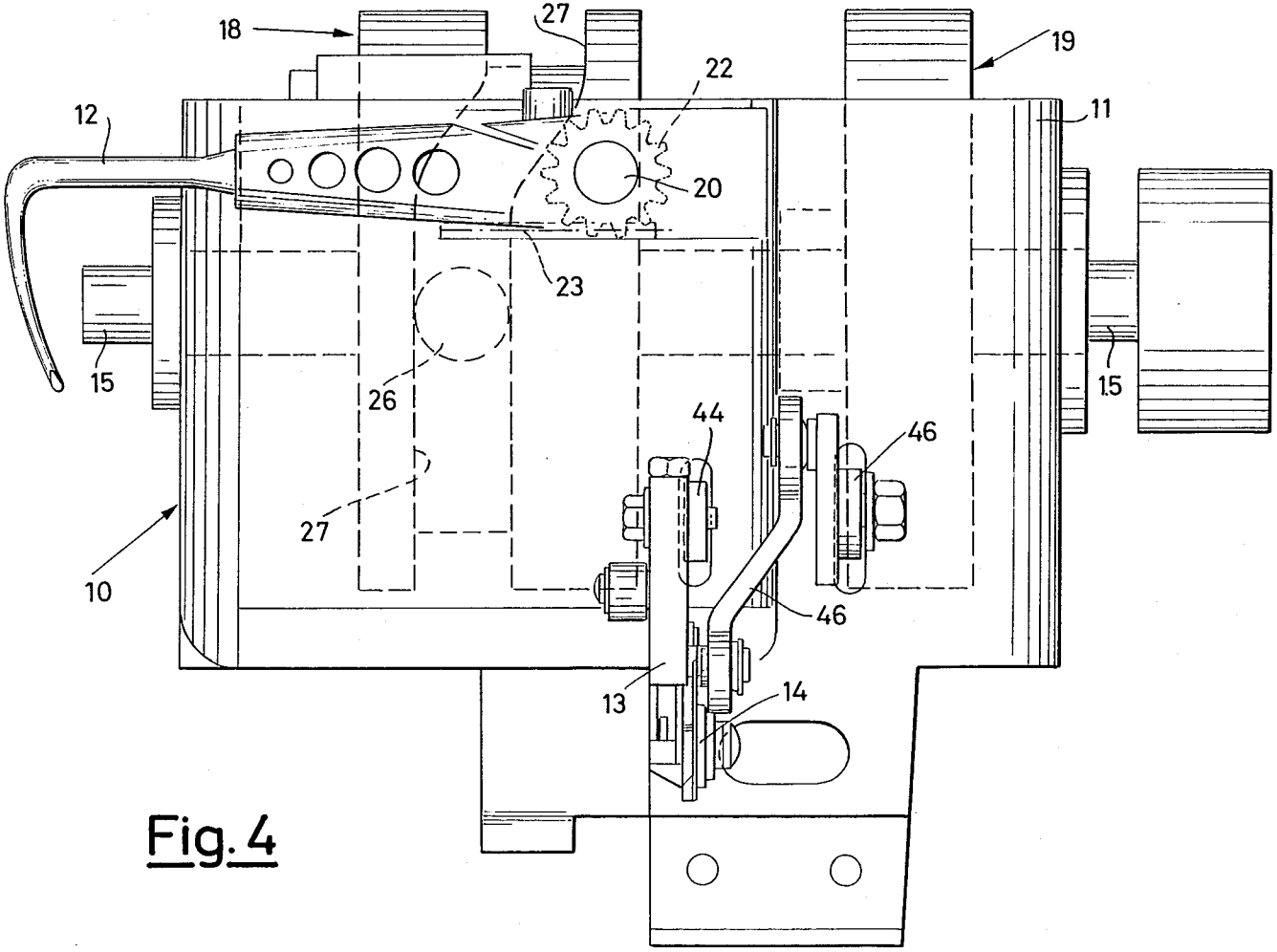
FIG. 4 is an elevational view taken in the direction shown by the arrow F in FIG. 1.

For this purpose the guide 35 is operatively connected to the pincer 13 through the agency of an idle roller 41 which is carried on one end of a pivotal link 44; the (FIGS. 1 and 2), the opposite end of which is connected to pincer 13 (FIGS. 1, 2, 4) to effect the rising and falling movement of the pincer in a manner generally similar to the pincers disclosed in the above-noted U.S. Pat. No. 4,076,049.

The guide 36 is also operatively connected to the pincer 13 through the agency of an idle roller 42 carried by one end of and a pivotal link 45; and the opposite end of this link is connected to the kinematism which controls the exit movement of the pincer.

The guide 37 is operatively connected to the scissors 14 through the agency of an idle roller 43 carried by one end of a pivotal link 46. As shown in FIGS. 1 to 4 the opposite end of link is connected in a conventional manner to control the opening and closing movement of the moveable blade of scissors 14 in a manner generally similar to that shown in FIG. 8 in U.S. Pat. No. 4,076,049.

In brief in a manner generally similar to that noted in U.S. Pat. No. 4,076,049 the pincer 13 and the scissors 14 (restrained one to the other) are caused first to make a forward movement of translation (exit) and of opening until they come proximal to the lowered hook-needle 12, where the pincer grips the weft, then a backwards rotation-translation movement (rising) to bring the weft into engagement with the needle 12 and, when the scissors have cut the weft, to return to the initial position in synchrony with the needle 12.

For this purpose, as it is shown in FIG. 6, the guides 35, 36 and 37 also feature non-operative sections 38, 39 and 40 respectively, similarly to those of the guides 27 and 30.

In other words, in the example mooted above, the guides 35, 36 and 37 are also operative only for an angle of 180° rotation of the main shaft 15.

FIG. 5 and 6 of the attached drawings illustrate the reciprocal positions of the cam-sensing rollers 41, 42 and 43 in the respective guides 35, 36 and 37 where, to indicate the corresponding positions, each reference number is followed by a letter of the alphabet.

The foregoing makes clear the manner in which the tucked selvedge forming machine of the invention can at every instant positively control the combined movements of the hook-needle 12, the pincer 13 and the scissors 14, at a rotation speed of the main shaft 15 that is a fraction of the rotation speed of the shaft of the weaving loom on which the forming machine is mounted—a speed at least double that of the shaft of the forming machine—if only two weft thread are tucked.

The tucked selvedge forming machine of the invention can naturally be applied for the realization of lightened and low-thickness selvedges both in normal and sponge fabrics, if it is requisite to tuck simultaneously two or more weft threads in one-and-the same- warp shed.

There is thus embodied a tucked selvedge forming machine that is highly dependable, silent in operation and of a long life-expetancy, inasmuch as the mechanical parts are only mildly stressed despite the high number of picks of the weaving loom.

I claim:

1. A tucked selvedge forming machine for forming a tucked selvedge in fabrics produced on shuttle-less looms of the type in which the ends of at least two weft threads are tucked simultaneously in the same warp shed, comprising a main shaft connected to the drive shaft of a shuttleless loom to be driven thereby at a number of revolutions equal to the number of revolutions of said drive shaft of the shuttleless loom divided by the number of ends of weft threads tucked simultaneously into the same warp shed created by said loom, means connecting a hook-needle, a thread seizing pincer, and a weft thread cutting scissors to said main shaft for operation thereby, said connecting means including a set of cams mounted on the main shaft, and a plurality of link systems connecting said hook-needle, said pincer and said scissors to said cams for actuation thereby, said cams being operative to actuate said hook-needle, said pincer and said scissors only during rotation of said cams for an angle equal to 360° divided by the number of weft threads that are simultaneously tucked in the same warp shed, and including means connecting one of said cams to at least two of said link systems.

2. A tucked selvedge forming machine as defined in claim 1, including means connecting one of said cams to at least two of said link systems.

3. A tucked selvedge forming machine as defined in claim 1, wherein said one cam is connected by one of said links systems to said hook-needle, and is connected by another of said link systems to said pincer.

4. A tucked selvedge forming machine as defined in claim 3, wherein said other system is connected both to said pincer and said scissors.

5. In a tucked selvedge forming machine of the type having a main shaft connected to the drive shaft of a shuttleless loom to be driven thereby, and a hook-needle, a thread seizing pincer, and a weft thread cutting scissors, and a plurality of link systems connecting said hook-needle, said pincer and said scissors to a set of cams on said main shaft to effect the simultaneous tucking of the ends of at least two weft threads into the same warp shed, the improvement comprising means connecting said main shaft to said drive shaft of said loom to be driven thereby at a number of revolutions equal to the number of revolutions of said drive shaft divided by the number of ends of weft threads tucked simultaneously into the same warp shed created by said loom, said cams being operative to actuate said hook-needle, said pincer and said scissors only during rotation of said cams for an angle equal to 360° divided by the number of weft threads that are simultaneously tucked in the same warp shed, and means connecting one of said cams to at least two of said link systems.

* * * * *